United States Patent [19]

Cedro

[11] Patent Number: 5,060,933

[45] Date of Patent: Oct. 29, 1991

[54] WRIST STICK COMBINATION UNIT EXERCISE DEVICE

[76] Inventor: Keith Cedro, P.O. Box 419 WOB, West Orange, N.J. 07052

[21] Appl. No.: 636,099

[22] Filed: Dec. 31, 1990

[51] Int. Cl.[5] ..... A63B 21/06

[52] U.S. Cl. ..... 272/67; 272/117

[58] Field of Search ..... 272/124, 67, 123, 122, 272/117

[56] References Cited

U.S. PATENT DOCUMENTS

| | | | |
|---|---|---|---|
| 2,470,816 | 5/1949 | Harvey | 272/122 |
| 4,411,423 | 10/1983 | Estwanik, III | 272/117 |
| 4,438,920 | 3/1984 | Veilette | 272/67 |

FOREIGN PATENT DOCUMENTS

| | | | |
|---|---|---|---|
| 1031855 | 3/1953 | France | 272/122 |

*Primary Examiner*—Robert Bahr
*Assistant Examiner*—Jerome W. Donnelly
*Attorney, Agent, or Firm*—Richard L. Miller

[57] ABSTRACT

A wrist stick combination unit exercise device is provided and includes an elongated bar having an annular flange on one end and a middle transverse aperture therethrough, a length of rope, a hanging weight, a plurality of different weight size disc weights and a pair of collar clamps. Many strengthening exercises for developing different muscles in the arms can be accomplished by a person using the various above components in a variety of combinations.

3 Claims, 2 Drawing Sheets

WRIST STICK COMBINATION UNIT EXERCISE DEVICE

BACKGROUND OF THE INVENTION

The instant invention relates generally to exercising devices and more specifically it relates to a wrist stick combination unit exercise device.

Numerous exercising devices have been provided in the prior art that are adapted to develop the muscles of various parts of the human body. For example, U.S. Pat. Nos. 2,475,656 to Bidak; 3,806,121 to Crossley and 4,645,203 to Moss all are illustrative of such prior art. While these units may be suitable for the particular purpose to which they address, they would not be as suitable for the purpose of the present invention as hereafter described.

SUMMARY OF THE INVENTION

A primary object of the present invention is to provide a wrist stick combination unit exercise device that will overcome the shortcomings of the prior art devices.

Another object is to provide a wrist stick combination unit exercise device that will develop the wrists and forearms of a person utilizing the exercise device.

An additional object is to provide a wrist stick combination exercise device in which three different exercises for the wrists and forearms can be accomplished by a person using the various components of the exercise device in different combinations.

A further object is to provide a wrist stick combination unit exercise device that is simple and easy to use.

A still further object is to provide a wrist stick combination unit exercise device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
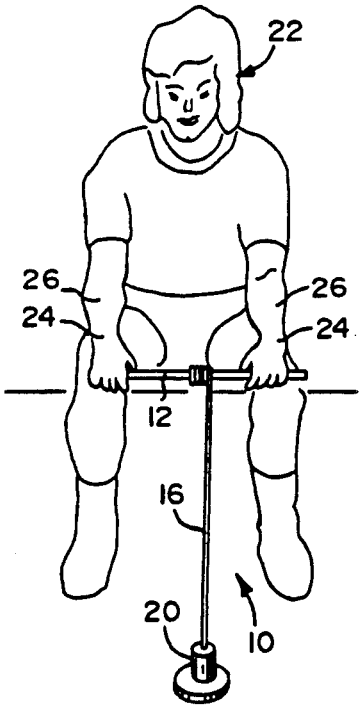
FIGS. 1, 2 and 3 are perspective views illustrating the invention being used in some typical exercising procedures.
Figure 4:
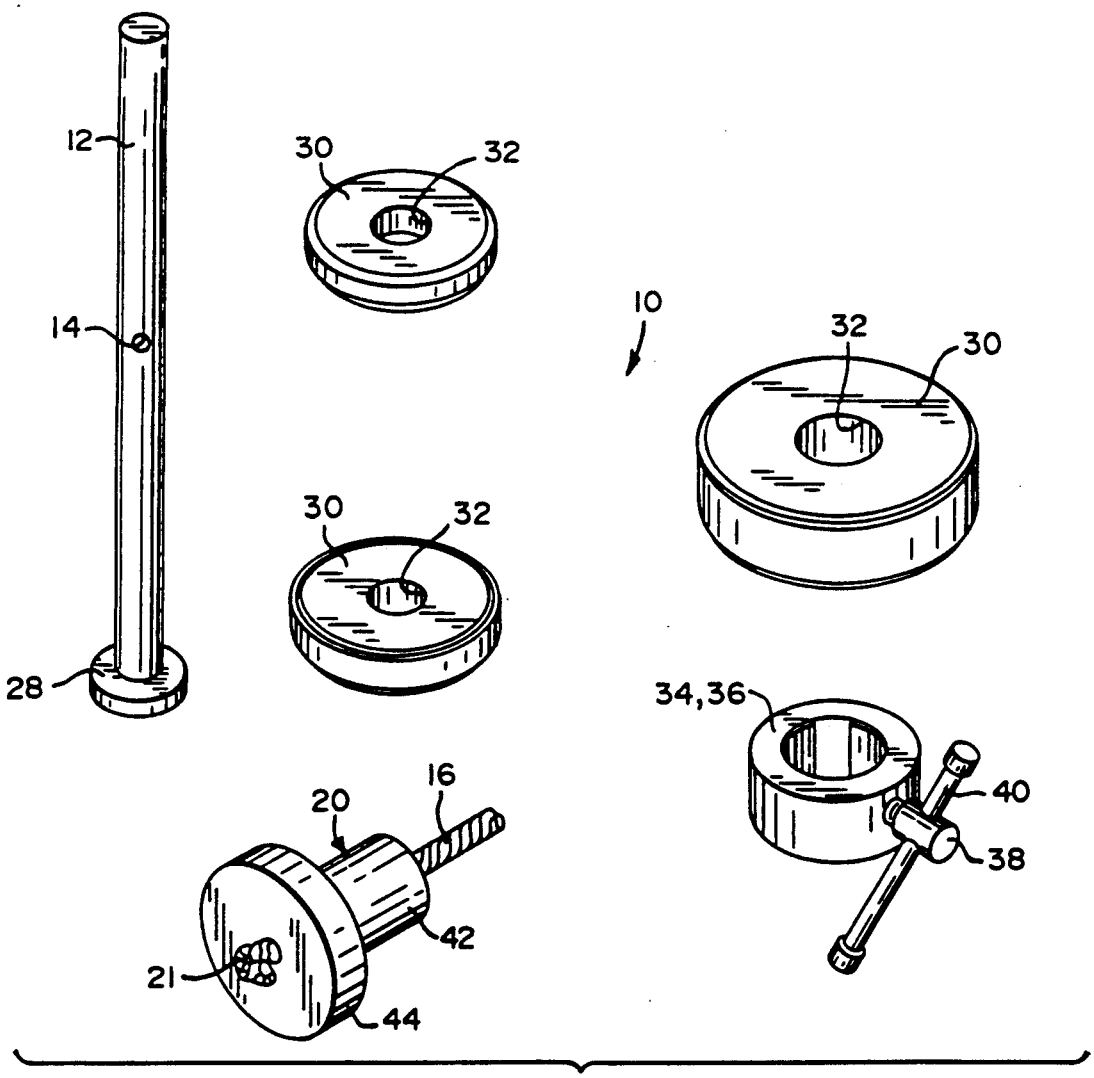
FIG. 4 is a perspective view illustrating the various components thereof separated from each other.
Figure 5:
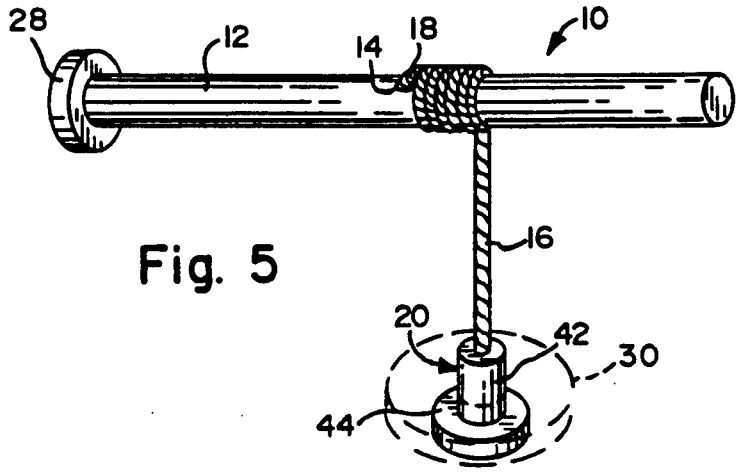

Turning now descriptively to the drawings, in which like reference characters denote like elements throughout the several views, the Figures illustrate a wrist stick combination unit exercise device 10 consisting of an elongated bar 12 that has a transverse aperture 14 therethrough, generally at the middle thereof. FIG. 4 illustrates a length of rope 16 has one end 18 placed into the transverse aperture 14 to be windable upon the elongated bar 12. A hanging weight 20 has the other end of rope 16 with a knot 21 typically tied therein so as to prevent the weight 20 from slipping off the end of the rope 16. The hanging weight 20 has a sleeve portion 42 and a flange portion 44 so that at least one additional weight 32 can be added as best illustrated in phantom in FIG. 4. A plurality of disc weights 30 are also provided, each being of a different weight size and have a center hole 32 sized to just fit on the sleeve portion 42 of hanging weight 20 but will not slide past flange 44. As shown in FIG. 1, a person can grip both ends of the elongated bar 12 to perform a wrist roll-up strengthening exercise to develop the wrists muscles 24 and the forearms muscles 26, with various disc weights 30 weighting the end of rope 16.

Figure 2:
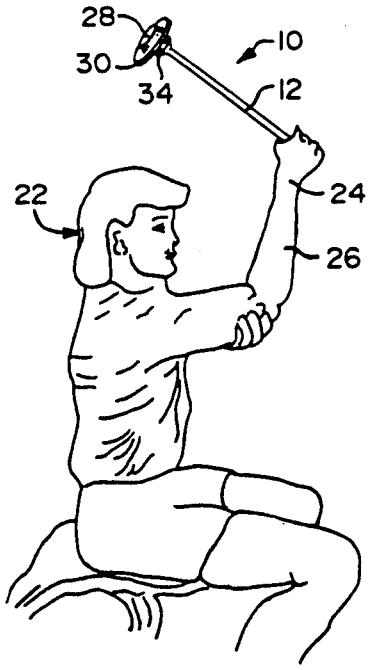

The elongated bar 12 has an annular flange 28 on one end. A same plurality of disc weights 30 have the same center hole 32 so as to fit upon the elongated bar 12 against the annular flange 28. A collar clamp 34 is to be secured on the elongated bar 12 against at least one of the disc weights 30 after the rope 16 and the hanging weight 20 are removed from the device 10. A shown in FIGS. 2 and 7, the person 22 can grip the free end of the elongated bar 12 to perform a wrist stick strengthening exercise to develop other wrists muscles 24 and forearms muscles 26.

Figure 3:
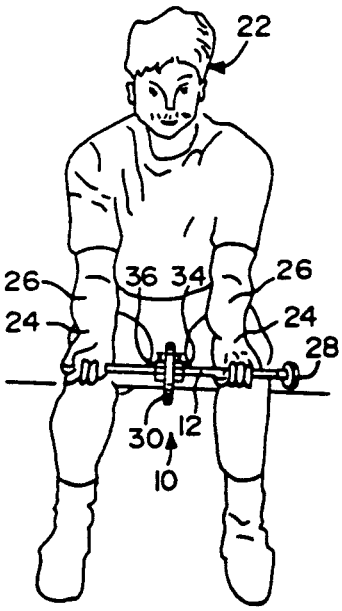
Figure 6:
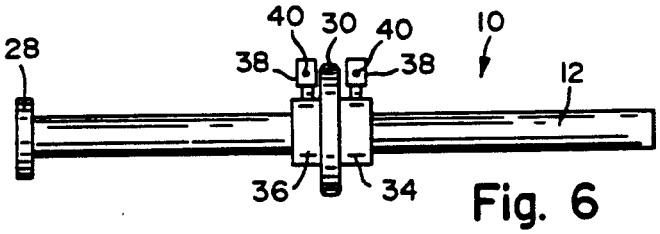
FIGS. 5, 6 and 7 illustrate the invention assembled so as to perform the various exercises as illustrated respectively in FIGS. 1, 3 and 2.
Figure 7:
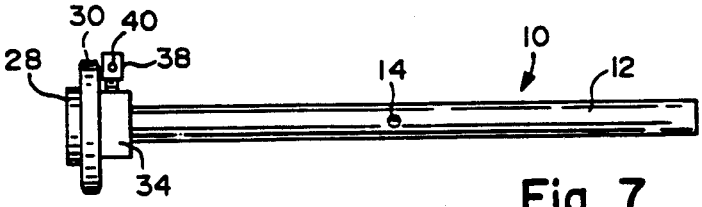

An additional second collar clamp 36 is to be secured on the elongated bar 12 generally at the middle thereof against at least one of the disc weights 30 on the opposite side thereof. As shown in FIG. 3 and 7, the person 22 can grip both ends of the elongated bar 12 to perform a wrist curl bar strengthening exercise to develop still further wrists muscles 24 and forearms muscles 26.

Each of the collar clamps 34, 36 includes a screw member 38 operable by a slideable handle member 40 to tighten each of the collar clamps 34, 36 onto the elongated bar 12.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A wrist stick combination unit exercise device comprising:

a) an elongated bar having an annular flange on one end and a transverse aperture therethrough generally at the middle thereof;

b) a length of rope having one end insertable into said transverse aperture to be windable upon said elongated bar;

c) a hanging weight having a sleeve portion and a flange with the other end of said length of rope connectable thereto; and d) a plurality of disc weights each being of a different weight size and having a center hole of a size which will allow said weights to slide over said elongated bar and said sleeve without slipping past the flange of said elongated bar and the flange of said sleeve; and e) a collar clamp to be secured on said elongated bar against at least one of said disc weights after said rope and said hanging weight are removed from said device, so that a person cap grip said elongated bar to perform a wrist roll-up strengthening exercise to develop the wrists muscles and the forearms muscles, and so that the person can grip the free end of said elongated bar to perform a strengthening exercise to develop the wrists muscles and the forearms muscles.

2. A wrist stick combination unit exercise device as recited in claim 1, further comprising a second collar clamp to be secured on said elongated bar generally at the middle thereof against at least one of said disc weights with said first collar clamp secured on said disc weights on the opposite side thereof, so that the person can grip both ends of said elongated bar to perform a wrist curl bar strengthening exercise to develop the wrists muscles and the forearms muscles.

3. A wrist stick combination unit exercise device as recited in claim 2, wherein each of said collar clamps includes a screw member operable by a slideable handle to tighten each of said collar clamps onto said elongated bar.

* * * * *